US009550159B2

(12) United States Patent
Bublewitz et al.

(10) Patent No.: US 9,550,159 B2
(45) Date of Patent: Jan. 24, 2017

(54) MIXER AND DISPENSING DEVICE

(75) Inventors: Alexander Bublewitz, Herborn (DE); Jens-Peter Reber, Meinerzhagen (DE)

(73) Assignee: Kettenbach GmbH & Co. KG, Eschenburg (DE)

( * ) Notice: Subject to any disclaimer, the term of this patent is extended or adjusted under 35 U.S.C. 154(b) by 0 days.

(21) Appl. No.: 14/240,234

(22) PCT Filed: Aug. 10, 2012

(86) PCT No.: PCT/EP2012/065738

§ 371 (c)(1),
(2), (4) Date: May 15, 2014

(87) PCT Pub. No.: WO2013/026721

PCT Pub. Date: Feb. 28, 2013

(65) Prior Publication Data

US 2014/0290773 A1 Oct. 2, 2014

(30) Foreign Application Priority Data

Aug. 24, 2011 (DE) ..... 10 2011 111 046

(51) Int. Cl.

| | |
|---|---|
| ***B67D 7/78*** | (2010.01) |
| ***B67D 7/80*** | (2010.01) |
| ***B01F 15/02*** | (2006.01) |
| ***B05C 17/005*** | (2006.01) |
| ***B01F 5/06*** | (2006.01) |
| ***B01F 13/00*** | (2006.01) |

(Continued)

(52) U.S. Cl.

CPC ..... *B01F 15/0202* (2013.01); *B01F 5/0615* (2013.01); *B01F 13/0023* (2013.01); *B01F 15/00928* (2013.01); *B01F 15/0216* (2013.01); *B05C 17/00513* (2013.01); *B05C 17/00553* (2013.01); *B05C 17/00579* (2013.01); *F17D 1/00* (2013.01); *Y10T 137/9029* (2015.04)

(58) Field of Classification Search

CPC ..... B05B 11/3084; A47K 5/1202; F16N 3/12; B65D 83/0005; B05C 17/00553; A01C 7/18; B29B 7/7663

USPC ..... 222/135, 137, 145.4, 145.6, 145.5, 325,222/326, 327, 328, 459, 567; 366/162.3, 189, 366/331, 181.5, 194, 177.1

See application file for complete search history.

(56) References Cited

U.S. PATENT DOCUMENTS 5,080,262 A * 1/1992 Herold et al. ..... 222/135
5,333,760 A 8/1994 Simmen (Continued)

FOREIGN PATENT DOCUMENTS

EP 0733022 B1 10/1999
EP 0730913 B1 10/2001

(Continued)

OTHER PUBLICATIONS

Form PCT/IB/338, Notification of Transmittal of Translation of the International Preliminary Report on Patentability, 10 pages.

*Primary Examiner* — J. Casimer Jacyna
*Assistant Examiner* — Benjamin R Shaw
(74) *Attorney, Agent, or Firm* — McDonnell Boehnen Hulbert & Berghoff LLP

(57) ABSTRACT

The invention relates to a delivery device having two containers (4*a*, 4*b*) that are connected with each other and a mixer (3). Preferably, the mixer can be connected with the containers (4*a*, 4*b*) by an outer thread (17). Thereby, the mixer has a coupling element (13), a mixer housing (11) rotatable relative to it and a mixing element (12) that is housed in the mixer housing (11).

14 Claims, 6 Drawing Sheets

(51) Int. Cl.
*B01F 15/00* (2006.01)
*F17D 1/00* (2006.01)

(56) References Cited

U.S. PATENT DOCUMENTS

| | | | | |
|---|---|---|---|---|
| 5,413,253 | A * | 5/1995 | Simmen | 222/137 |
| 5,918,772 | A * | 7/1999 | Keller et al. | 222/145.6 |
| 6,523,992 | B1 * | 2/2003 | Bublewitz et al. | 366/172.1 |
| 6,769,574 | B1 * | 8/2004 | Keller | 222/137 |
| 2008/0029542 | A1 * | 2/2008 | Keller | 222/145.5 |
| 2010/0208544 | A1 | 8/2010 | Wintergerste et al. | |
| 2011/0198370 | A1 | 8/2011 | Ho et al. | |
| 2012/0199607 | A1 | 8/2012 | Keller | |

FOREIGN PATENT DOCUMENTS

| | | | |
|---|---|---|---|
| EP | 1440737 | A1 | 7/2004 |
| EP | 1968751 | B1 | 4/2011 |
| EP | 2335641 | A1 | 6/2011 |
| WO | 2009033832 | A1 | 3/2009 |
| WO | 2011/041917 | A1 | 4/2011 |

* cited by examiner

MIXER AND DISPENSING DEVICE

CROSS REFERENCE TO RELATED APPLICATIONS

The present application is a 35 U.S.C. 371 National Application of PCT/EP2012/065738 filed Aug. 10, 2012, which claims priority to German Patent Application No. 10 2011 111 046.5, filed Aug. 24, 2011, the entire contents of which are incorporated entirely herein by reference.

The invention relates to a mixer with a coupling element having inlet connectors, a mixer housing that is rotatable relative to the coupling element that has an outlet opening and an opposite inlet end that houses the coupling element, and a mixing element housed by a mixer housing that defines a longitudinal axis of the mixer. Further, the invention relates to a delivery device having at least two containers that are connected with each other, as well as a mixer of that type.

A mixer of the type cited at the beginning, as well as a corresponding delivery device are known, for example, from EP 0 733 022 B1, whereby the mixer can be locked at the cartridge by means of a bayonet lock. The seal between the coupling element of the mixer and the mixer housing is between an approximately cylindrical outer wall of the coupling element and a corresponding inner wall of the mixer housing. The mixer known from EP 0 733 022 B1 is a so-called static mixer, i.e. a mixer in which the mixing element cannot be driven to rotate. A similar delivery device is also known from U.S. Pat. No. 5,333,760 or EP 0 730 913 B1.

EP 1 968 751 B1 also describes a mixer, as well as a delivery device, whereby the mixer consists only of a mixer housing and a mixing element that is housed in it. Thereby, the mixer housing and also the mixing element take on functions of a coupling element to connect with a cartridge housing.

EP 2 335 641 A1 describes a double cartridge and a static mixer that can be connected with it. The connection between the mixer and the double cartridge is accomplished with a bayonet connection that is provided on a cap, which surrounds the coupling element and the mixer housing and can be rotated relative to it. In this mixer, the coupling element is designed integral with the mixing element, whereby these are in turn retained rotatable in the mixer housing. A similar solution using a connecting nut is known from EP 1 440 737 A1.

Known mixers and delivery devices have the inherent danger that these can be separated from each other when the components contained in the containers are delivered at pressures that are too high. This can occur either when using highly viscous or pasty materials, or when the delivery speed was selected a rate that was too high. Additionally, there can be leaks within the mixer itself, in particular, between the mixer housing and the coupling element when the delivery pressure is too high.

Instead of connecting the components of the mixer by means of a catch mechanism that is, as described above, susceptible to leaks, the components can also be welded, for example, by using ultrasonic welding. However, this is expensive and therefore not ideal for disposable mixers.

The connection between the mixer and the cartridge requires, for example, in the solutions according to EP 0 733 022 B1 or EP 2 335 641 A1, a visual control and an exact placement of the mixer in a predetermined position. This has been found to be cumbersome and impractical. Additionally, in mixers according to prior art, even during the assembly of the mixer, a specific alignment of the coupling element relative to the mixer housing is required, because the mixer could otherwise not be placed onto the cartridge. This requires an additional cost-generating assembly step, including the required quality control.

Therefore, it is the objective of the present invention to provide a mixer and a delivery device of the type cited at the beginning that avoids the disadvantages of the aforementioned known mixers and, in particular, allows for an improved connection between the mixer and the cartridge, and also an improved sealing of the mixer itself.

This problem is solved with a mixer according to the invention that has the features of Claim 1. Thereby, the inlet end of the mixer housing is provided with an outer thread. This makes it possible to screw the mixer into a sleeve-like structure of a cartridge, for example, that is provided with an inner thread. The screw connection by means of a thread makes accepting larger loads possible compared with other types of connections, for example, a bayonet closure that has only a spatial effect. The risk that the mixer pops off the cartridge can thus be minimized, even at high delivery pressure. A special advantage is also given thereby, that the mixer housing itself is provided with an outer thread, because at high delivery pressure, the force flows directly between the mixer housing and the cartridge and therefore, no additional components such as, for example, connecting nuts or caps as it is known in prior art, are provided as to compensate for possible weak spots. Furthermore, in the case of a screw connection, different than in a bayonet lock, neither an exact alignment of the mixer to the cartridge or the like, nor of the mixer housing and the coupling element is required.

In some application cases, the components to be mixed in the mixer are present in different parts by volume. Correspondingly, the inlet connectors of the mixer or the outlet connectors of the cartridge can be of a different size. In order to make the specific placement of the mixer onto the cartridge easier, it is therefore preferred that the coupling element has a positioning latch projecting parallel to the inlet connectors that protrudes over the inlet connectors in the direction facing away from the outlet opening. Such a positioning latch can prevent that the mixer is fastened to the cartridge while out of alignment. In particular, it can also be prevented hereby that an undesired contact of the mixer inlet connectors and the outlet connectors or outlet openings of the cartridge takes place, which can lead to a mixing of components that are already in the area of the cartridge, which then harden and render the cartridge unusable. Alternatively, an opening can also be provided at the mixer with which a positioning latch or the like of the cartridge engages.

In a refinement of this inventive idea it is provided that the positioning latch is tapered in the direction facing away from the outlet opening. This facilitates the "finding" of the positioning latch and a corresponding opening contour. Simultaneously, this can be a preliminary alignment of the coupling element relative to the cartridge, so that the inlet connectors and the outlet connectors meet in an ideal alignment.

In other words, the fastening of a mixer according to the invention to a cartridge requires the following steps: First, the positioning latch makes contact with the corresponding adapter at the cartridge starting at a certain point, whereby at the beginning, there is play between the positioning latch and the adapter of the cartridge. After that, the positioning latch functions just like a guide track in a, for example, conically tapered channel in the cartridge. As a consequence, the mixer is hereby automatically centered and aligned in the cartridge because of the axial insertion of the positioning latch.

In order to make screwing the mixer onto a cartridge or the like easier, it is preferred when the thread is a multiple thread, in particular, a three-part thread. This not only provides three starting points for a threaded engagement, but a rotation of the mixer toward the cartridge by a comparably small amount, for example, in the case of a three-part thread, by only 120°, is sufficient for establishing a firm connection between the mixer and the cartridge. Thereby, it is especially preferred when the threads of the mixer and the corresponding threads of the cartridge are recessed, so that the mixer can be inserted first with its mixer housing into, for example, a sleeve-like adapter of the cartridge and the two threads engage only thereafter.

Preferably, the mixer is designed in such a way that the coupling element has sealing means on the side that faces its outlet opening. When the coupling element is housed in, for example, a pot-like inlet end of the mixer housing, the sealing effect between the coupling element and the mixer housing is improved as the result of tightening the screw connection of the mixer and the cartridge. Additionally, the sealing effect is also improved by an output pressure that is exerted on the coupling element. With increasing pressure, the coupling element consequently also seals—in a frontal seal of this type—more strongly with respect to the mixer housing.

In a refinement of this inventive idea it is provided that the coupling element has two annular protrusions on its side facing the outlet opening, between which a surrounding groove is formed with which an annular protrusion of the mixer housing engages forming a seal. In other words, between the mixer housing and the coupling element, a circular groove-spring-connection is created, which although it makes a rotation of the coupling element relative to the mixer housing possible, it simultaneously also achieves a particularly good sealing effect. Alternatively, this axial seal can also be structured in reverse, i.e. with a groove in the mixer housing that engages with a ring-like protrusion of the coupling element.

Further, even an additional threaded connection can be formed between the coupling element and the mixer housing so that the coupling element is pulled into the mixer housing by the hub defined by the additional thread while the mixer is being fastened to a cartridge upon a relative rotation of the mixer housing. This ensures a defined sealing effect.

The previously described axial sealing represents a preferred embodiment of the invention. In spite of that, it is alternatively possible to provide a radial seal instead of an axial seal, for example, by means of a radial groove in the mixer housing and a ring-like protrusion in the coupling element.

The inlet connectors of the coupling element advantageously extend parallel to the longitudinal axis of the mixer and thereby form channels, which preferably end via respectively at least one radial opening in a mixing area formed by the mixer housing, in which the mixing element is provided. At least one of the channels ending in the mixing area can thereby be provided with a redirection, for example, when a channel section, for example, extends curved around the longitudinal axis of the mixer. Alternatively or in addition to this, it is also possible that at least one of the channels forms a first section extending in the direction of the longitudinal axis of the mixer, a subsequently attached U-shaped redirection forms a further channel section extending parallel to the first section that then ends in the mixing area. This can reduce the likelihood that one of the components runs ahead, so that a good mixing result is achieved from the start. Additionally, this also decreases the risk of back contamination at the end of the mixing process, i.e. substances contained in the mixing area cannot or, in any event, only with difficulty, flow back into the cartridge. Alternatively or in addition to this, it is also possible to decrease the cross section of at least one of the openings ending in the mixing area by a partition or the like.

When the coupling element has at least one catch protrusion protruding radially outward that engages with a radial groove in the inlet end of the mixer housing, a (pre) assembly of the mixer can take place in such a way that the coupling element and the mixer housing are provided already connected with each other without posing the danger that the coupling element falls out of the mixer housing. The steps required for assembling the mixer are thus reduced to the insertion of the mixing element into the mixer housing and the interlocking of the coupling element in the mixer housing.

Preferably, the coupling element is retained freely rotatable in the mixer housing. This is required, on the one hand, in order to make an alignment of the inlet connectors of the mixer with the corresponding outlet connectors of the cartridge possible, and on the other hand, also the screwing tight of the mixer housing at the cartridge. Thus, the coupling element can be located in any (rotary) position of the inlet connectors relative to the mixer housing without impairing the connecting process of mixer and cartridge.

It has been shown to be particularly advantageous when the coupling element is also retained in the mixer that is displaceable at least by a limited amount in axial direction parallel to the longitudinal axis of the mixer. This can be accomplished thereby, for example, that the radial groove in the inlet end of the mixer housing is slightly larger in axial direction than the catch protrusion of the coupling element. The axial displaceability of the coupling element relative to the mixer housing can, for example, be less than 1 mm, in particular, between 0.1 mm and 0.5 mm. Thereby, on the one hand, small tolerances can be compensated within the mixer while the mixer is being screwed onto a cartridge, and on the other hand, it is also possible to improve the sealing effect between the coupling element and the mixer housing during the screwing on process by pressing the coupling element more firmly against the mixer housing.

The mixer according to the invention can be designed either as a static mixer, i.e. a mixer not having a driven mixing element, or as a dynamic mixer with a driven mixing element. In dynamic mixers, an opening is formed in the coupling element through which the mixing element can extend in such a way that it can be connected with a drive shaft. Frequently, this is a hexagonal shaft that can engage with a corresponding hexagonal socket of the mixing element.

Regardless of the previously described features, the invention also relates to a mixer with a coupling element with inlet connectors, a mixer housing that is rotatable relative to the coupling element that has an outlet opening and an opposite inlet end which houses the coupling element, and a mixing element housed in the mixer housing that defines a longitudinal axis of the mixer. Thereby, the coupling element is preferably provided with a bearing sleeve in which the mixing element is mounted rotatable and sealed. In this way, the imperviousness of the dynamic mixer can be improved further. In a particularly preferred embodiment of this inventive idea, the bearing sleeve is an approximately cylindrical component that is retained only at one end, or only in sections within the coupling element. A free end of the bearing sleeves can thereby abut the mixing element in a sealing manner, so that even small angular deviations between the alignment of the longitudinal axis of the mixing element and the longitudinal axis of the remaining mixer components can be compensated.

Instead of an outer thread at the mixer housing, for a dynamic mixer, a bayonet attachment means can also be provided at the mixer housing, which, for example, is formed by bayonet latches sticking out radially.

Regardless of the type of mounting of the mixer to the cartridge, even in dynamic mixers, the alignment of the coupling element relative to the cartridge or the like, by means of a positioning latch that engages with the corresponding opening contour, is preferred. Thereby, the positioning latch can also prevent that the inlet connectors and the outlet connectors are aligned incorrectly.

The invention further relates to a delivery device with at least two containers that are connected with each other that have a common outlet section with outlet connectors for each container, and with a mixer that can be detachably connected with the outlet section that has a coupling section with inlet connectors that can respectively be connected with an outlet connector, a mixer housing and a mixing element housed in the mixer housing. The outlet section of the containers is designed with a threaded inner section according to the invention for connecting with an outer threaded section of the mixer housing. Preferably, this is a multiple thread, in particular, a three-part thread.

The at least two containers of the delivery device can be combined into a cartridge, whereby the containers are provided, for example, parallel next to each other or stacked inside each other.

According to an especially preferred embodiment of the delivery device according to the invention, either the outlet section of the containers or the coupling element of the mixer has a positioning latch that can extend parallel to the inlet or outlet connectors, for example. Further, in the coupling element of the mixer or in the outlet section of the containers, an opening contour is provided for receiving the positioning latch. This opening contour can, for example, be larger than the positioning latch or be designed funnel-shaped, in order to facilitate inserting the positioning latch into the opening contour.

To prevent an incorrect placement of the mixer onto the containers and an unintentional contact of the mixer inlet connectors with the outlet connectors or the openings of the cartridge, the positioning latch projects over the inlet connectors of the mixer in the direction facing away from the outlet opening in such a way that the inlet connectors and the outlet connectors engage only then, when the positioning latch is at least partially housed in the opening contour. Even the threaded sections of the mixer and the containers preferably engage only then, when the positioning latch is housed in the opening contour.

Preferably, the positioning latch is guided to slide funnel-shaped into the opening when the outlet connectors are pushed into the inlet connector to form a seal. In other words, the positioning latch is in contact with the opening during the assembly of the mixer onto the containers of the cartridge and aligns the inlet and outlet connectors as well as the threads with each other. In practice, this is relevant especially for a frequent change of mixers at a cartridge inserted into a delivery device, as the inlet and outlet connectors are usually hidden from the user so that it is important that the connectors and the thread align automatically.

In a refinement of the inventive idea it is provided that the positioning latch and the opening contour are designed in such a way that the positioning latch can only be inserted into the opening contour in an exact position. This can be accomplished, for example, thereby, that the positioning latch and the corresponding opening contour are designed curved or convex or, for example, unsymmetrical.

According to a further embodiment of the invention, the outlet section of the containers is provided with a plate at which the outlet connectors abut flush, and in which an opening contour is provided for housing the positioning latch. Thereby, an annular collar is attached to the plate which has an inner threaded section. This makes a particularly good transmission of force possible between the mixer and the containers.

Preferably, the plate has ribs that can be located, for example, between the outlet connectors. With respect to the plate, the ribs protrude in the direction of the mixer and thus additionally prevent that the mixer is positioned incorrectly. Beyond that, such a transverse ribbing between and/or underneath the outlet channels of the cartridge can prevent, for example, an unintentional carryover of catalytic paste or base paste of a two-component mixture to the respectively other channel. Contaminations of the cartridge collar base with catalytic or base impression mass, for example, upon pulling the mixer out of a cartridge for a mixer change—with one cartridge up to 10 or more impressions, i.e. delivery processes are performed, respectively with a new mixer are usually unavoidable in day to day operations. The transverse ribs, however, catch the mass flowing downward in the section between the ribs and thus prevent a fast carryover to the respectively other outlet channel. Material that is carried over could lead to a contamination of the respectively one component with the other component, i.e. lead to premature hardening, jamming of the channels or instability of the filled material.

In addition to preventing an incorrect insertion of the positioning latch or the channels, the transverse ribbing has a further important second function of preventing the carryover and contamination of the two pastes to the respectively other channel.

Further, the invention relates to a delivery device with at least two containers that are connected with each other that have a common outlet section with outlet connectors for each container and a locking element that can be detachably connected with the outlet section. The outlet section of the containers thereby has a threaded inner section and the locking element has catch means that can be detachably mounted to the inner thread. Preferably, the containers have outlet connectors and the locking element has stoppers that can be inserted into such, whereby the stoppers are connected with the catch means by a torsion element. In other words, the locking element can be a one-piece component that locks into the cartridge and can be lifted off as a result of rotation.

In the following, the invention will be explained in further detail with the help of an exemplary embodiment and by referring to the drawing.

Schematically shown are:

Figure 1:
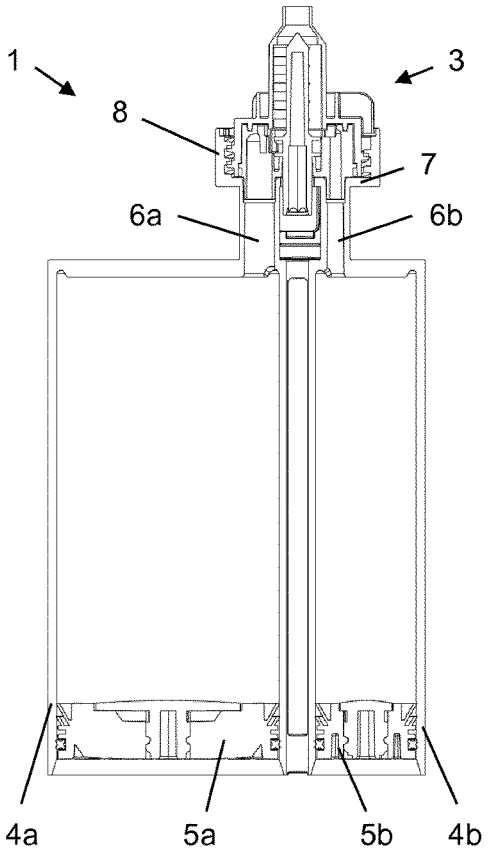
FIG. 1 shows a cross sectional view of a delivery device according to the invention.
Figure 2:
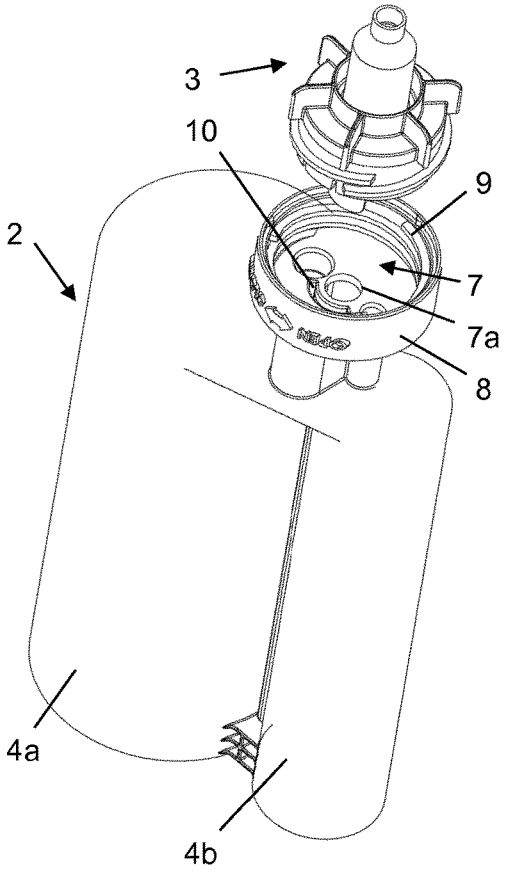
FIG. 2 shows the delivery device according to FIG. 1 prior to putting on the mixer.
Figure 3:
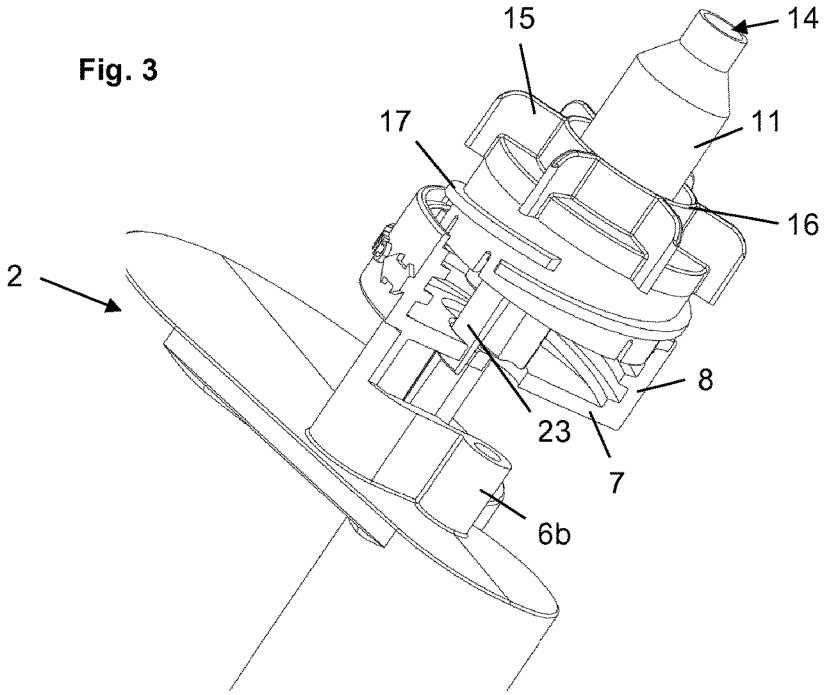
FIG. 3 shows an enlarged view of the delivery device according to FIG. 1 while the mixer is being placed on it.
Figure 4:
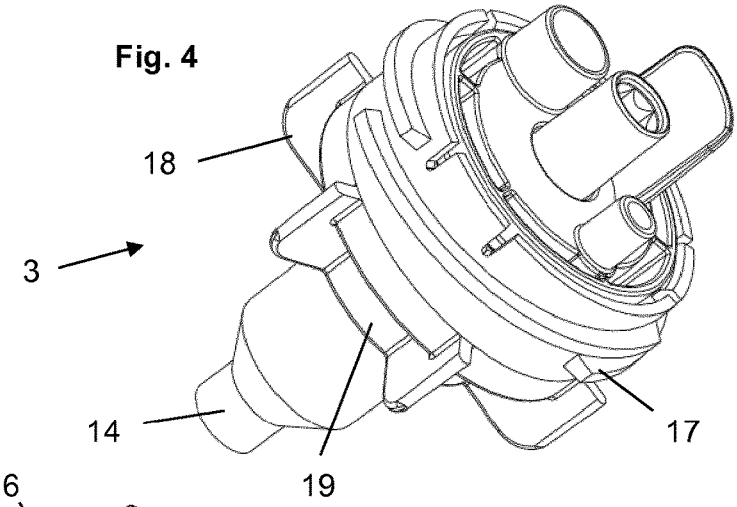
FIG. 4 shows the mixer according to the invention in a perspective view.

Delivery device 1 that is shown in FIG. 1 through 3 consists of a double cartridge 2 and a mixer 3 that can be connected detachable with double cartridge 2. In the illustrated embodiment, double cartridge 2 is formed by two integrally connected containers 4*a*, 4*b* that have a different cross section in order to accept different volumes of two different components, in particular, a base mass and a catalytic mass for the production of a dental product. The two containers, 4*a*, 4*b* are closed by delivery plungers 5*a*, 5*b* at their end facing away from mixer 3, which can be pushed forward within double cartridge 2, in order to deliver the components contained in containers 4*a*, 4*h* by means of mixer 3. The embodiment according to FIG. 1 is a so-called directly filled cartridge, in which the components are directly housed in containers 4*a*, 4*b*. Alternatively, it is also possible to accept components in pouches that are in turn inserted into the containers.

Each of the two containers 4*a*, 4*b* has an outlet connector 6*a* or 6*b*, whereby the outlet connectors form a common outlet section of double cartridge 2. For this, the two outlet connectors 6*a*, 6*b* are provided with a plate 7, which extends perpendicular to outlet connectors 6*a*, 6*b*, so that outlet connectors 6*a*, 6*b* end flush with plate 7. In the direction of mixer 3, a surrounding collar 8 that is provided with an inner thread 9 projects away from a plate 7. Further, an arched opening 10 is formed in plate 7. Between the two containers 4*a*, 4*b* of double cartridge 2, a channel extends for housing a drive shaft (not shown), which also ends flush with a central opening 7*a* in plate 7. Different than in the illustrate embodiment, openings 7*a* and 10 can also be designed as a common opening.

Figure 6:
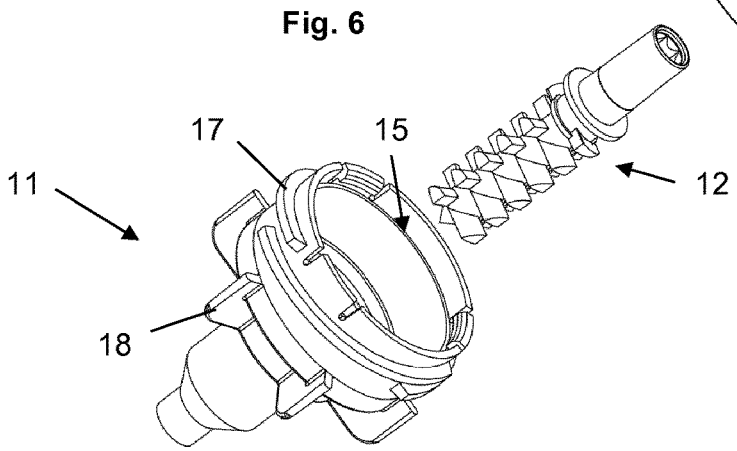
FIG. 6 shows the components of the mixer according to FIG. 4 in an exploded view.

As can be seen in the illustration in FIG. 6, mixer 3 consists of a mixer housing 11 that forms a mixing area in its interior, a mixing element 12 housed in the mixer housing and a coupling element 13 (cover), which can be connected with the mixer housing. At its end facing away from double cartridge 2, mixer housing 11 is provided with an outlet opening 14 that is tapered with respect to the cylindrical section of mixer housing 11 that forms the mixing area. The inlet end of mixer housing 11 that is opposite to outlet opening 14 is widened pot-like to house coupling element 13. Coupling element 13 can thereby be locked into mixer housing 11, by means of a surrounding groove 15 designed into mixer housing 11 into which an annular catch protrusion 16 can snap on the outer side of coupling element 13. Thus, coupling element 13 is retained freely rotatable in mixer housing 11. Depending on the size of groove 15 and catch protrusion 16, coupling element 13 can, however, displace slightly in axial direction, for example, less than approximately 1 mm relative to the mixer housing in axial direction.

Mixer 3 that is shown in the Figures is a dynamic mixer in which mixing element 12 can be driven by the drive shaft (not shown). For this, mixing element 12 extends through a central opening in coupling element 13 and can engage with the central opening 7*a* in plate 7 of the outlet end of double cartridge 2. Mixing element 12 bears several mixing blades with which components fed into the mixing area by double cartridge 2, can be mixed with each other before these discharge from outlet opening 14.

The mixer housing is provided with an outer thread 17, which is provided on the outside of the pot-like enlarged inlet end of mixer housing 11. Outer thread 17 and inner thread 9 are coordinated with each other to connect mixer 3 with double cartridge 2. In the illustrated embodiment, the threads are a three-part thread with three threaded sections. Hereby it is possible to engage threads 9 or 17 at respectively three points offset by 120°. Beyond that, only a small rotation of mixer 3 relative to double cartridge 2 is required for screwing the mixer onto the double cartridge. The threaded connection can be designed in such a way that a defined snap-in position is indicated tactile and/or audible when mixer 3 is screwed onto double cartridge 2 completely. This can be accomplished, for example, thereby that the thickness of the treaded segments (spiral-shaped threaded ribs) slightly increases at the end of the screw-in path and decreases subsequently, so that a small resistance must be overcome in order to completely tighten or release the threads.

Further, on the outside of mixer housing 11, wings 18 are provided that facilitate screwing in mixer 3 manually. Wings 18 thereby extend between a flange 19 that surrounds the cylindrical part of mixer housing 11, and the pot-like expanded inlet end of the mixer housing. Flange 19 affords the advantage that wings 18 cannot lead to an irregular contraction delay in the cylindrical part of mixer housing 11. This in turn ensures that the mixing blades of mixing element 12 can be stripped off with very narrow tolerances at the cylindrical inner wall of the mixing area formed by mixer housing 11. This is an advantage for a homogeneous mixture. Alternatively, or in addition to wings 18, other means can also be provided that facilitate the manual screwing on of mixer 3, for example, a (multi) angular design of sections of mixer housing 11.

Figure 7:
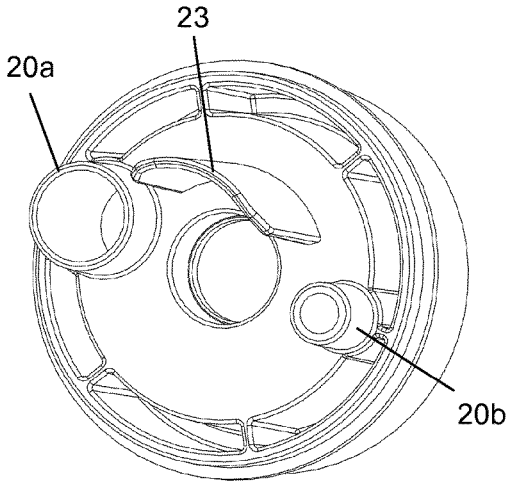
FIG. 7 shows the rear side of the coupling element of the mixer according to FIG. 4.
Figure 8:
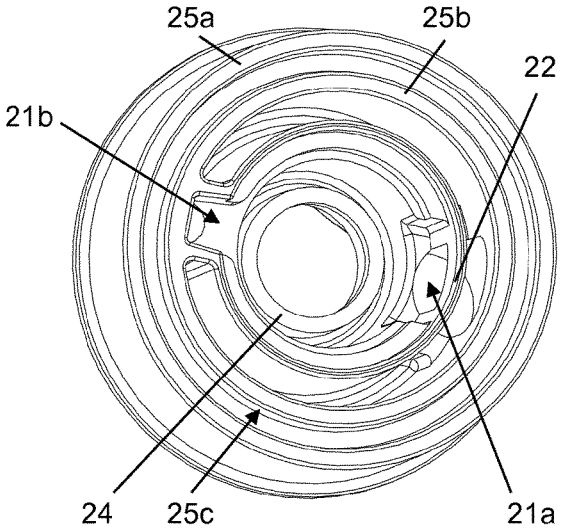
FIG. 8 shows the front side of the coup ing element of the mixer according to FIG. 4.
Figure 9:
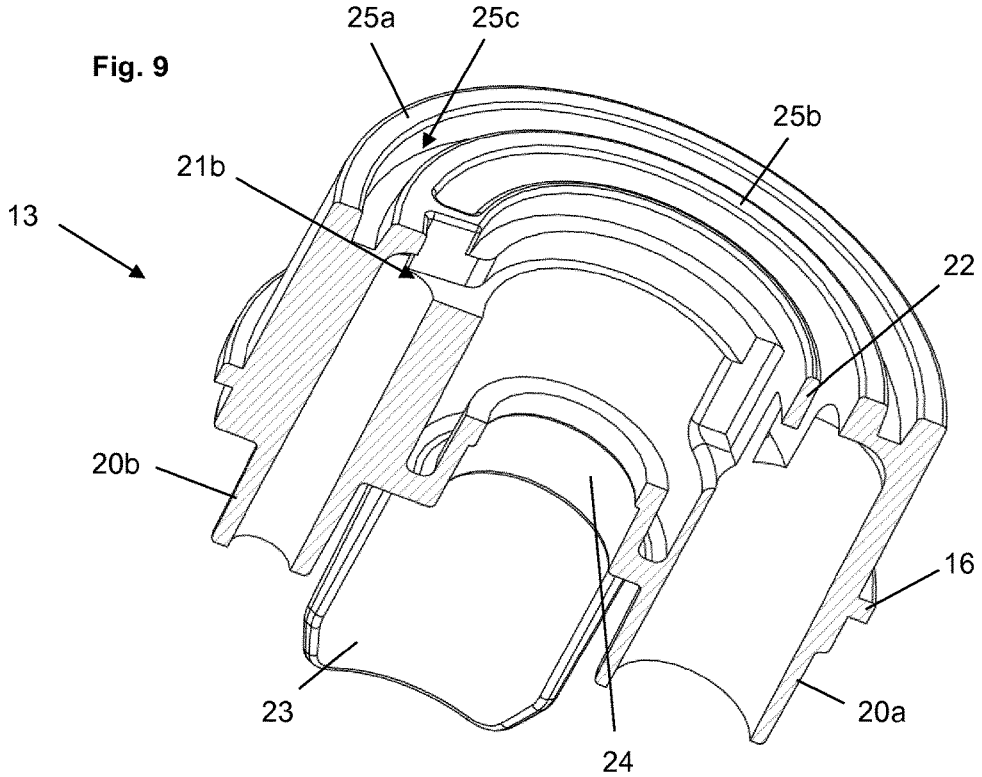
FIG. 9 shows a cross sectional view of the coupling element of the mixer according to FIG. 4.

The design of coupling element 13 can be seen in FIG. 7 through 9, whereby FIG. 7 shows the rear side facing double cartridge 2, and FIG. 8 the opposite front wall of coupling element 13. Two inlet connectors 20*a*, 20*b* are formed in the coupling element that protrude in the direction toward double cartridge 2 out of a rear wall of coupling element 13. As can be seen in FIG. 1, the size of inlet connectors 20*a*, 20*b* is selected in such a way that these can be inserted into outlet connectors 6*a*, or 6*b* of double cartridge 2. Inlet connectors 20*a*, 20*b* form channels that extend parallel to the longitudinal axis of the mixer, i.e. parallel to the axis of rotation of mixing element 12. Via openings 21*a*, 21*b*, the channels end radially into an area that forms the mixing area of mixer housing 11. Opening 21*a* for the larger component by volume is reduced in its cross section by a partition 22, as a result of which a running ahead of this component can be prevented.

Further, at coupling element 13, a positioning latch 23 is formed which likewise extends from the rear side of coupling element 13 in the direction toward double cartridge 2. Positioning latch 23 is convexly curved in the illustrated embodiment, and adapted to the contour of opening 10 in plate 7 of double cartridge 2. As can be seen in the Figures, positioning latch 23 projects over inlet connectors 20*a*, 20*b* in the direction toward double cartridge 2. In other words, when mixer 3 is placed onto double cartridge 2, first positioning latch 23 makes contact with plate 7 until positioning latch 23 engages with opening 10. Hereby, inlet connectors 20*a*, 20*b* of mixer 3 become aligned with the openings ending in plate 7 of outlet connectors 6*a* or 6*b*. At the same time, the end of mixing element 12 that protrudes out of coupling element 13 can engage with the central opening of plate 7. For an easier finding of opening 10, positioning latch 23 is tapered at an incline or rounded at its free end. Alternatively or additionally, opening 10 can be designed larger than positioning latch 23 and/or be tapered.

For sealing mixing element 12 in coupling element 13, a bearing sleeve 24 is provided in coupling element 13, in which mixing element 12 is mounted rotatable. Bearing sleeve 24 thereby has a free end aligned in the direction to outlet opening 14 of mixer 3, while the opposite end of bearing sleeve 24 ends in the rear wall of coupling element 13. The free end of bearing sleeve 24 can thus abut at mixing element 12 in sealing manner.

At the front end of coupling element 13 facing outlet opening 14 of mixer 3, two surrounding, annular protrusions 25*a*, 25*b* are provided that are concentric to each other, so that between them, a surrounding groove 25*c* is formed. Correspondingly, in the inlet end of mixer housing 11 that expands like a pot, an annular, surrounding protrusion 26 is formed that can engage with groove 25*c*. In a not yet screwed together condition with double cartridge 2, mixer 3 can have a little play between the free end of annular protrusion 26 and the base of the groove of groove 25*c*, so that coupling element 13 is freely rotatable within mixer housing 11. When mixer 3 is placed onto the outlet end of double cartridge 2 and is screwed tight, the rear wall of coupling element 13 abuts at plate 7 of double cartridge 2. Hereby, coupling element 13 is slightly displaced in axial direction toward outlet opening 14 of mixer 3 relative to mixer housing 11, so that the free end of protrusion 26 rests on the base of the groove of groove 25*c* that is formed between protrusions 25*a* and 25*b* in sealing manner. Even when the delivery pressure rises, for example, as a result of a fast feed rate of delivery plunger 5*a* or 5*b*, coupling element 13 is pushed in the direction toward outlet opening 14 so that the seal between annular protrusion 26 and the base of the groove seals more effectively.

Preferably, collar 8 of double cartridge 2, as well as the inlet section of mixer 3 are designed in such a way that the respective threads 9. 17 are slightly recessed so that mixer 3 can first be inserted into collar 8 without an engagement of the threads. In this position, mixer 3 can be aligned relative to double cartridge 2 by being rotated until positioning latch 23 meets opening 10. The threads only engage thereafter and the inlet connectors are guided into the outlet connectors. In other words, mixer 3 can only be placed onto double cartridge 2 in a single position. For this reason, a cross contamination of the mixer inlet connectors by the cartridge outlet connectors at the start is impossible.

Additionally, a purely tactile, intuitive positioning of the mixer is possible as a result of the rotating motion of the mixer in the collar. A visual control or an exact placement of the mixer is not necessary. A further advantage of the mixer according to the invention lies therein, that no special alignment of the coupling element relative to the mixer housing or the double cartridge is required. Thus, an additional cost-generating assembly step including the required quality control is not necessary.

Alternative to the positioning of mixer 3 illustrated in the Figures with respect to double cartridge 2 by means of the positioning latch, the inlet connector of the mixer can also be designed with a larger diameter (for example, base component) longer than the other inlet connector with the smaller diameter (e.g. catalytic component). Even in this way, a positioning and alignment can take place, as the larger inlet connector cannot be inserted into any other opening within plate 7 than the opening of the corresponding outlet connector. A positioning latch is therefore not necessary.

Figure 10:
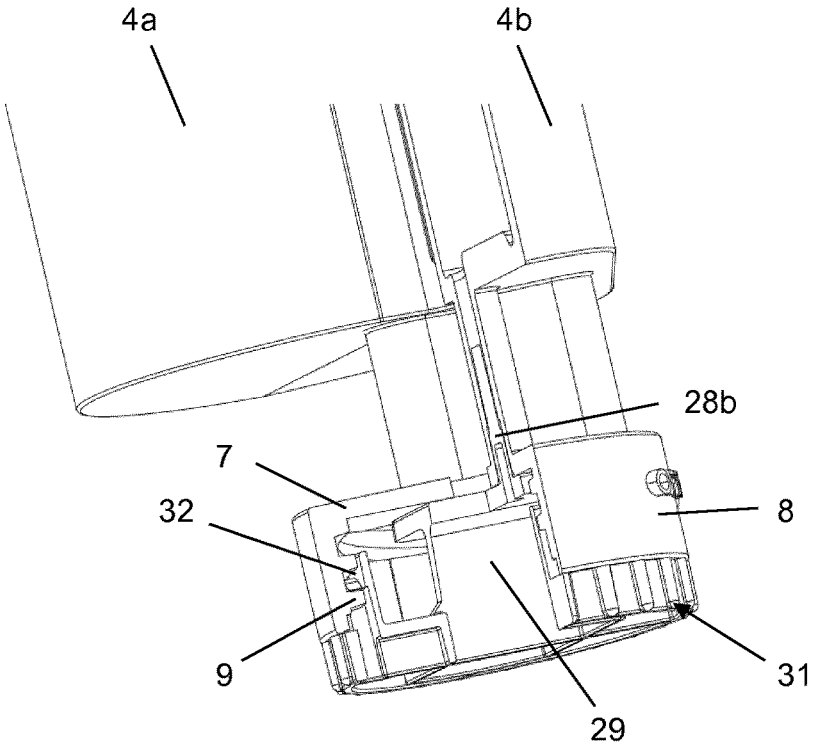
FIG. 10 shows the cartridge according to the invention with a locking element in a perspective view.
Figure 11:
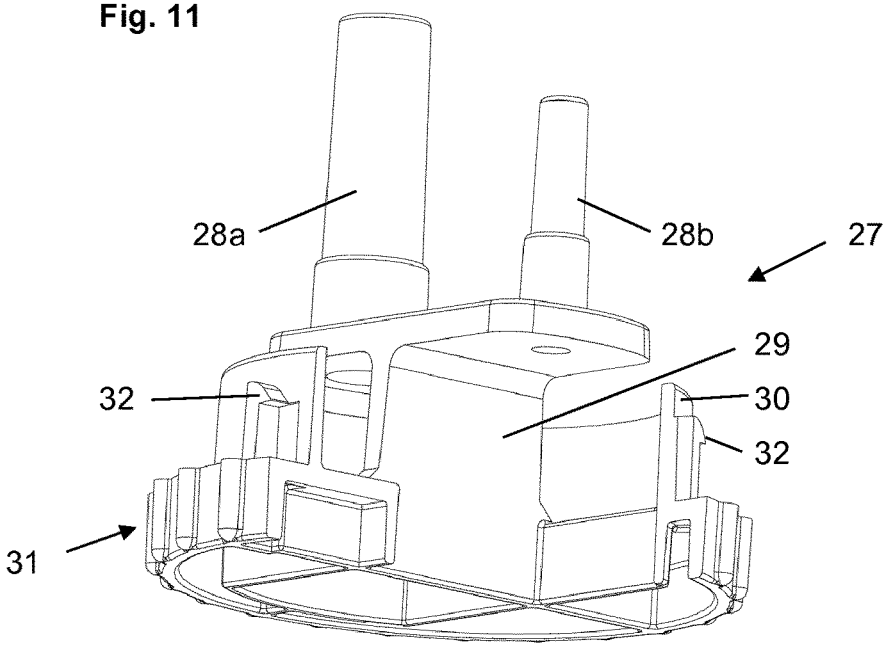
FIG. 11 shows the locking element according to FIG. 10 in a perspective view.

Regardless of the features of the mixer described above and/or the cartridge, the invention also relates to a one piece locking element 27 that is shown in FIGS. 10 and 11, which can be placed onto double cartridge 2 instead of mixer 3. For locking double cartridge 2, two stoppers 28*a*, 28*b* are provided that can be inserted into outlet connectors 6*a* or 6*b* to seal them. Stoppers 28*a*, 28*b* are connected with a sleeve 30 by a bar 29 that acts as torsion spring, which can be used in collar 8 of the outlet end of double cartridge 2. An expanded edge of sleeve 30 that is provided with a knurling 31 rests on the front side of collar 8 when locking element 27 is inserted in double cartridge 2 in sealing manner.

Locking element 27 can be secured in collar 8 by means of engagement hooks 32 that engage behind the threaded segments of inner thread 9 and thus interlock locking element 27 on the double cartridge. To release locking element 27, sleeve 30 with knurling 31 can be rotated slightly, whereby bar 20 deflects, as stoppers 28*a*, 28*h* at first continue to be in outlet connectors 6*a* or 6*b*. This deflection of bar 29 that acts as torsion element makes it possible that engagement hooks 32 are made to disengage from the threaded segments of inner thread 9, so that locking element 27 can be removed from double cartridge 2.

Figure 12:
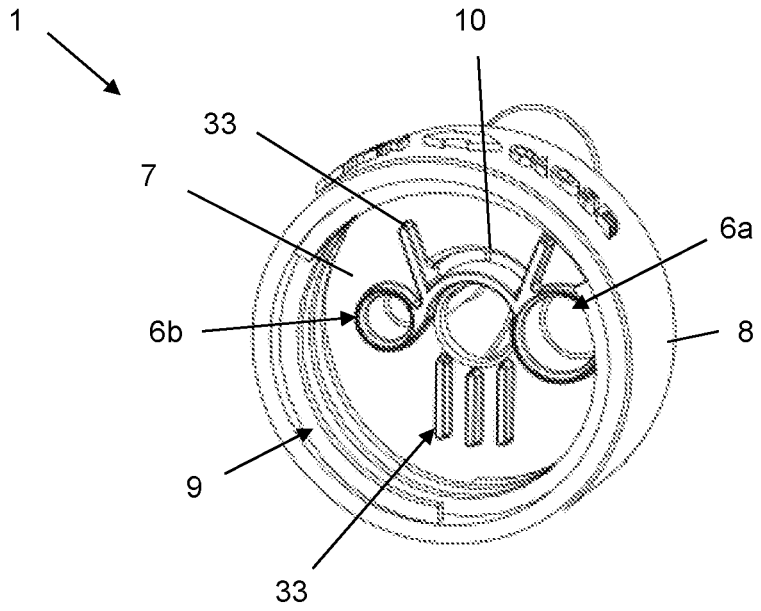
FIG. 12 shows a detail of an additional embodiment of a delivery device in a perspective view.

A preferred embodiment of the design of the delivery device is shown in FIG. 12. Thereby, between or under outlet connectors 6*a*, 6*b*, ribs 33 are formed on plate 7, that protrude from plate 7. On the one hand, this prevents an erroneous placement of the mixer so that positioning latch 23 finds opening 10 more easily, and on the other hand, it can prevent a carryover of material. When the mixer is exchanged, a material discharge from the inlet and/or outlet connectors can rarely be avoided entirely. Contact of the two material components stored separately in the cartridge must, however, be avoided prior to the intended mixing in the mixer, as the material components would otherwise react with each other. Transverse ribs 33 catch such material components in the section between the ribs and thus prevent a fast carryover to the respectively other outlet channel.

Figure 13:
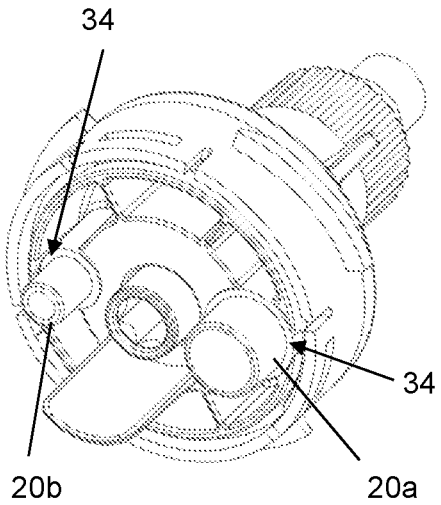
FIG. 13 shows a further embodiment of a mixer in a perspective view.
Figure 14:
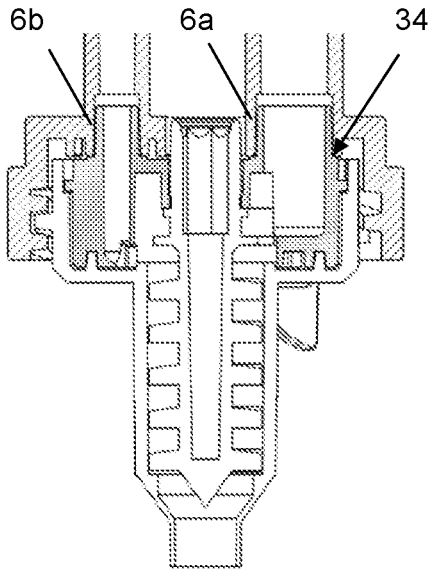
FIG. 14 shows a cross sectional view of the mixer according to FIG. 13 in a cartridge system.

The mixer shown in FIGS. 13 and 14 has annular frontal sealing surfaces 34 at coupling element 13 that are provided around inlet channels 20*a*, 20*h*, and on which the respective outlet connectors 6*a*, 6*b* come to rest. These sealing surfaces have a frontal sealing effect in addition to the radial sealing surface at the exterior circumference of the connectors.

Figure 5:
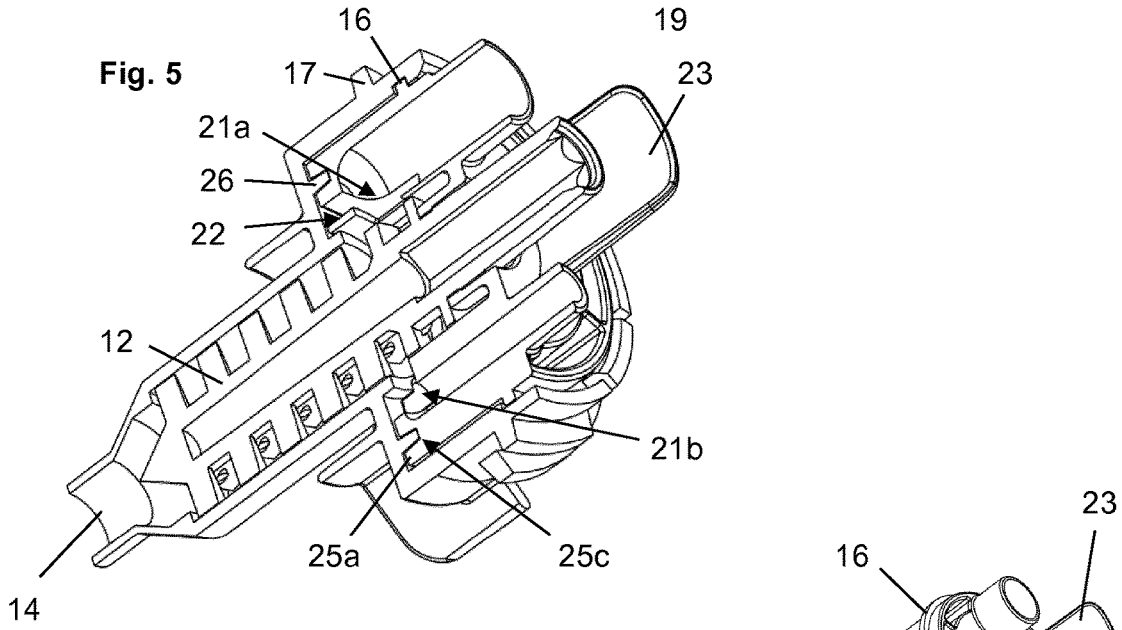
FIG. 5 shows a cross sectional view of the mixer according to FIG. 4.

Different than in the illustration in FIGS. 5 and 14, for a better mixing homogeneity, it can be advantageous to install an additional mixing blade or mixing element at the upper (outlet side) end of mixing element 12 in the direction of the mixer outlet, where FIGS. 5 and 14 has a pointed cone, which follows the contour of the tapered mixer sleeve and projects into the mouth of the mixer.

| Reference numbers: | |
|---|---|
| 1 | Delivery device |
| 2 | Double cartridge |
| 3 | Mixer |
| 4a, b | Container |
| 5a, b | Delivery plunger |
| 6a, b | Outlet connectors |
| 7 | Plate |
| 7a | Opening |
| 8 | Collar |
| 9 | Inner thread |
| 10 | Opening |
| 11 | Mixer housing |
| 12 | Mixing element |
| 13 | Coupling element |
| 14 | Outlet opening |
| 15 | Groove |
| 16 | Catch protrusion |
| 17 | Outer thread |
| 18 | Wings |
| 19 | Flange |
| 20a, b | Inlet connectors |
| 21a, b | Opening |
| 22 | Partition |
| 23 | Positioning latch |
| 24 | Bearing sleeve |
| 25a, b | Protrusion |
| 25c | Groove |
| 26 | Protrusion |
| 27 | Locking element |
| 28a, b | Stopper |
| 29 | Bar |
| 30 | Sleeve |
| 31 | Knurling |
| 32 | Engagement hook |
| 33 | Rib |
| 34 | Frontal sealing surfaces |

What is claimed is:

1. A mixer with a coupling element having inlet connectors, a mixer housing rotatable relative to the coupling element that has an outlet opening and an opposite inlet end in which the coupling element is housed, and a mixing element housed in the mixer housing that defines a longitudinal axis of the mixer, wherein the inlet end of mixer housing has an outer thread for connecting with a cartridge and the coupling element has a positioning latch that extends parallel to the inlet connectors protruding over inlet connectors in the direction facing away from outlet opening, wherein the coupling element has two annular protrusions on its side facing the outlet opening between which a surrounding groove is formed with which an annular protrusion of mixer housing engages in sealing manner.

2. A mixer as recited in claim 1, wherein the coupling element has sealing means on its side facing outlet opening.

3. A mixer as recited in claim 1, wherein the inlet connectors of the coupling element form channels extending parallel to the longitudinal axis of the mixer that end via at least one radial opening respectively, in a mixing area formed by the mixer housing.

4. A mixer as recited in claim 1, wherein the cross section of at least one opening ending in the mixing area is reduced by a partition.

5. A mixer as recited in claim 1, wherein the positioning latch is tapered in the direction facing away from the outlet opening.

6. A mixer as recited in claim 1, wherein the coupling element is retained in the mixer housing freely rotatable and perhaps displaceable by a limited amount in axial direction parallel to the longitudinal axis of the mixer.

7. A mixer as recited in claim 1 wherein the coupling element has a bearing sleeve, in which the mixing element is mounted rotatable and sealed.

8. A mixer as recited in claim 1, wherein the inlet end of the mixer housing comprises a plurality of detents with a radial groove being provided in said detents.

9. A delivery device with at least two containers connected with each other that have a common outlet section with outlet connectors for each of the containers, and a mixer that can be connected detachable with the outlet section of the containers as recited in claim 1, that has a coupling element with inlet connectors that are respectively connectable with one outlet connector, a mixer housing and a mixing element housed in the mixer housing, wherein the outlet section of the containers has an inner threaded section for a connection with the outer threaded section of the mixer housing, and that the outlet section of the containers has a plate at which the outlet connectors end flush, whereby the plate is attached to an annular collar, in which the inner, threaded section is formed, wherein the outlet section of the containers or the coupling element of the mixer has a positioning latch extending parallel to the inlet connectors or the outlet connectors, and that in the coupling element of the mixer or in the outlet section of the containers an opening contour is provided for receiving the positioning latch.

10. A delivery device as recited in claim 9, wherein the positioning latch protrudes over the inlet connectors in the direction facing away from the outlet opening in such a way, that the inlet connectors and the outlet connectors engage only then, when the positioning latch is at least partially housed in opening contour, and/or that the positioning latch and the opening contour are designed in such a way that the positioning latch can be inserted into the opening contour only in one exact position and/or that the positioning latch is guided to slide funnel-shaped into opening, when the outlet connectors are inserted into the inlet connectors to establishing a seal.

11. A mixer as recited in claim 9, wherein the inlet end of the mixer housing comprises a plurality of detents with a radial groove being provided in said detents.

12. A mixer with a coupling element having inlet connectors, a mixer housing rotatable relative to the coupling element that has an outlet opening and an opposite inlet end in which the coupling element is housed, and a mixing element housed in the mixer housing that defines a longitudinal axis of the mixer, wherein the inlet end of mixer housing has an outer thread for connecting with a cartridge and the coupling element has a positioning latch that extends parallel to the inlet connectors protruding over inlet connectors in the direction facing away from outlet opening, wherein the coupling element has at least one catch protrusion protruding radially outward that engages with a radial groove in the inlet end of the mixer housing.

13. A delivery device with at least two containers connected with each other that have a common outlet section with outlet connectors for each of the containers, and a mixer that can be connected detachable with the outlet section of the containers as recited in claim 1, that has a coupling element with inlet connectors that are respectively connectable with one outlet connector, a mixer housing and a mixing element housed in the mixer housing, wherein the outlet section of the containers has an inner threaded section for a connection with the outer threaded section of the mixer housing, and that the outlet section of the containers has a plate at which the outlet connectors end flush, whereby the plate is attached to an annular collar, in which the inner, threaded section is formed, wherein a central opening is provided in the plate for housing mixing element and/or ribs are formed in plate.

14. A mixer with a coupling element having inlet connectors, a mixer housing rotatable relative to the coupling element that has an outlet opening and an opposite inlet end in which the coupling element is housed, and a mixing element housed in the mixer housing that defines a longitudinal axis of the mixer, wherein the inlet end of mixer housing has an outer thread for connecting with a cartridge and the coupling element has a positioning latch that extends parallel to the inlet connectors protruding over inlet connectors in the direction facing away from outlet opening, wherein the mixer housing has two annular protrusions on its inlet end between which a surrounding groove is formed with which an annular protrusion of the coupling element engages in sealing manner.

* * * * *